US005664449A

United States Patent [19]

Sedley

[11] Patent Number: 5,664,449

[45] Date of Patent: Sep. 9, 1997

[54] MAGNETIC LOCKS

[76] Inventor: Bruce Samuel Sedley, Flat C, Fifth Floor, Block 30, Mei Foo Sun Chuen, Broadway Street, Kowloon, Hong Kong

[21] Appl. No.: 356,189

[22] PCT Filed: Apr. 16, 1993

[86] PCT No.: PCT/GB93/00807

§ 371 Date: Feb. 16, 1995

§ 102(e) Date: Feb. 16, 1995

[87] PCT Pub. No.: WO94/00659

PCT Pub. Date: Jan. 6, 1994

[30] Foreign Application Priority Data

Jun. 26, 1992 [GB] United Kingdom ..... 9213652

[51] Int. Cl.[6] ..... E05B 47/00

[52] U.S. Cl. ..... 70/276; 70/413; 70/38 C

[58] Field of Search ..... 70/276, 413, 213–221, 70/38 A, 38 B, 38 C

[56] References Cited

U.S. PATENT DOCUMENTS

| | | | |
|---|---|---|---|
| 2,384,208 | 9/1945 | Stroud | 70/413 |
| 2,595,769 | 5/1952 | Cooley | 70/413 X |
| 2,648,729 | 8/1953 | Noregaard | 70/413 |
| 3,056,276 | 10/1962 | Auander | 70/413 |
| 3,552,159 | 1/1971 | Craig | 70/413 X |
| 3,657,907 | 4/1972 | Boving | 70/276 X |
| 3,742,739 | 7/1973 | Hickman | 70/276 X |
| 3,857,262 | 12/1974 | Sidiropoulos | 70/38 C X |
| 3,974,669 | 8/1976 | Stackhouse | 70/413 X |
| 4,312,198 | 1/1982 | Sedley | 70/413 X |
| 4,676,083 | 6/1987 | Sedley et al. | 70/276 |
| 4,932,228 | 6/1990 | Eisermann | 70/276 |
| 5,074,135 | 12/1991 | Eisermann | 70/276 |
| 5,074,136 | 12/1991 | Kim et al. | 70/276 |
| 5,267,459 | 12/1993 | Sedley | 70/276 |
| 5,388,437 | 2/1995 | Sedley | 70/276 |

FOREIGN PATENT DOCUMENTS 37212 6/1973 Australia .

*Primary Examiner*—Suzanne Dino
*Attorney, Agent, or Firm*—Gunn, Lee & Miller, PC

[57] ABSTRACT

A magnetic key operated lock has an anti-rap arrangement which comprises a magnet pin supported in a bar mounted in a slide member. The remote end of the pin fits into an aperture in a locking plate and is pivoted to swing downwards out of the aperture when a correctly coded key is inserted into the lock. The correctly coded key has a repelling spot to pivot the magnet as required and before the key attempts to move the slide member from its locked position. Rapping on the face of the lock cannot move the remote end of the magnet pin out of the aperture because it is restrained by its pivoting action from moving laterally out of the locking plate. Another anti-rap arrangement includes a padlock incorporating both anti-rap arrangements.

15 Claims, 5 Drawing Sheets

MAGNETIC LOCKS

BACKGROUND OF THE INVENTION

The invention relates to magnetic locks.

The invention relates more particularly to magnetic locks operated by magnetic cards in which provision is made to prevent the lock being opened by sharp impacts or so-called "rapping".

Early card-operated locks were designed for installation inside a wall or door and the key was inserted into a slot in a flush-mounted faceplate. Applying impacts to the slot or to the surface of the door or wall seldom caused unlocking as the pins moved perpendicularly to the plane of the card slot, but when the same lock was housed in a box and mounted on the surface of the wall or door, or on a post for access by car drivers entering a parking garage, the top surface above the lock was available for impacting and sharp blows could often jar the pins up and down. If a non-magnetic card-shaped object was inserted in the slot during the "rapping", the lock could sometimes be unlocked. Magnetic pin card-operated locks which are susceptible to this type of tampering are described for example in U.S. Pat. Nos. 2,566,017, 2,648,729, 2,732,703, 2,769,873, 2,931,953, 3,271,983, RE27,753, 3,595,042, 3,581,030, and 3,995,145. U.S. Pat. No. 3,705,277 describes the problem and discloses a solution which utilizes a "tamper-resistant non-magnetic pin" which, when moved by a rapping impact causes the lock to remain locked by blocking movement of the slider that contains the tumbler pins.

Nearly all of the above locks were required to be mounted horizontally, (parallel to the floor), as the pins were held in locking positions mainly by gravity. However, where a steel shield plate is used to attract all the magnetic pins towards the slot, as described in U.S. Pat. No. 3,834,197, the lock is able to be mounted vertically. U.S. Pat. No. 3,995,460 describes how a magnetic pin can be used to block slider movement if the lock is rapped on the front surface in direct line with the locking pins. This "anti-rap" pin has been shown in subsequent U.S. Pat. Nos. 4,133,194, 4,676,083, 4,312,198 and 4,932,228.

Padlocks incorporating a magnetic card-operated lock such as described in U.S. Pat. No. 3,834,197 are known in the art, however this type of lock has not been successfully produced due to its possible susceptibility to being unlocked without a correct card being inserted, by rapping on the body of the lock while a blank card is in the slot, and held under constant or intermittent pressure.

SUMMARY OF THE INVENTION

According to the invention there is provided a magnetic key operated lock comprising a slide member movable from a locked position to an unlocking position with a key having a magnetic code encoded in it inserted in the lock, a plurality of magnet pins slidable transversely of the slide member from a first position locking the slide member in said locked position to a second position unlocking said slide member on operation of the lock by a said key, and a locking plate alongside the slide member having a plurality of apertures for receiving remote ends of the magnet pins when the slide member is in the locked position, the position and polarity of some or all of the magnet pins forming a code for the lock, in which at least one of the magnet pins is supported in the slide member so that its remote end is prevented mechanically, even if the lock is rapped, from moving transversely from its locked position in use whenever the slide member is urged from the locked position towards the unlocking position unless a coded key is inserted in the lock which first causes the remote end to move out of the locking plate.

The at least one magnet pin must be pivotably mounted in the slide member about an axis transverse to the slidable axes of the other magnet pins so that the remote end can move out of the locking plate by pivoting in the direction of movement of a correctly coded key into the lock.

The at least one magnet pin may extend or have a housing extending beyond its pivot point and the lock includes a shoulder which bears against the extension or housing to pivot the magnet pin further in the same direction and into alignment with the slide member as the slide member moves towards its unlocking position.

A stationary finger must be mounted adjacent one end of the slide member which engages the extension or the housing when the slide member moves from its unlocking position towards its locked position to cause the magnet pin to rotate in an opposite direction and its remote end to move into its respective aperture in the locking plate.

In an embodiment of the invention at least one magnet pin may be formed to fit snugly in the slide member, so as to be movable in the slide member only along a fixed axis, the magnet pin being provided with or having a lateral protrusion at its remote end which fits flush with a surface of the slide member in an indentation in that surface, and the lock plate may have a stepped aperture through which the lateral protrusion can pass and lodge against the step to prevent travel of the remote end of the magnet pin away from the locking plate unless the central axis of the magnet pin is aligned with a central axis of the stepped aperture.

The lateral protrusion may comprise a peripheral rim at the said remote end.

The magnet pin may have a uniform cross-section along its total length and is surrounded and held in a separate sheath which fits snugly in the slide member, the sheath being integrally formed with said lateral protrusion. The sheath may be formed of metallic or plastics material.

An embodiment of the invention may include a plurality of magnet pins and two further magnet pins, a first pin which is pivotably mounted in the slide member about an axis transverse to the slidable axes of the other magnet pins so that a remote end of the first magnet pin can move out of the locking plate by pivoting in the direction of movement of a correctly coded key into the lock, and a second magnet pin which is formed to fit snugly in the slide member, so as to be movable in the slide member only along a fixed axis, the second magnet pin being provided with or having a lateral protrusion at its remote end which fits flush with a surface of the slide member in an indentation in that surface, and the lock plate has a stepped aperture through which the lateral protrusion can pass and lodge against the step to prevent travel of the remote end of the second magnet pin away from the lock plate unless the central axis of the second magnet pin is aligned with a central axis of the stepped aperture.

An embodiment of the invention may comprise a padlock having a magnetic key operated lock in which the lock is provided with an anti-rap module having a slider member released to move when a correctly coded card is inserted in the module. The padlock includes a release arm which mechanically cooperates with the slide member when it moves to allow the padlock to open; the module is removably secured to the padlock.

The module may be releasable by removing a fixing means inside the lock, which fixing means is accessible through a shackle hole when the end of the shackle is removed.

The module may incorporate a lock code changing mechanism including a rotatable carrier for one or more magnet pins, in which the carrier can be rotated by a key inserted into the module to change the code and/or by a code changing magnetic card inserted in the module when the lock is operated.

Magnetic key operated locks according to the invention will now be described by way of example with reference to the accompanying drawings in which:

DETAILED DESCRIPTION OF THE PREFERRED EMBODIMENT

The operation of the locks in relation as to how the magnetic code is arranged, and how the keys or cards are coded, is fully described in several earlier patents, for example U.S. Pat. No. 4,312,198. The magnetic code arrangements of the locks does not directly form a part of the invention and so will not be described in any detail in this specification.

Figure 1:
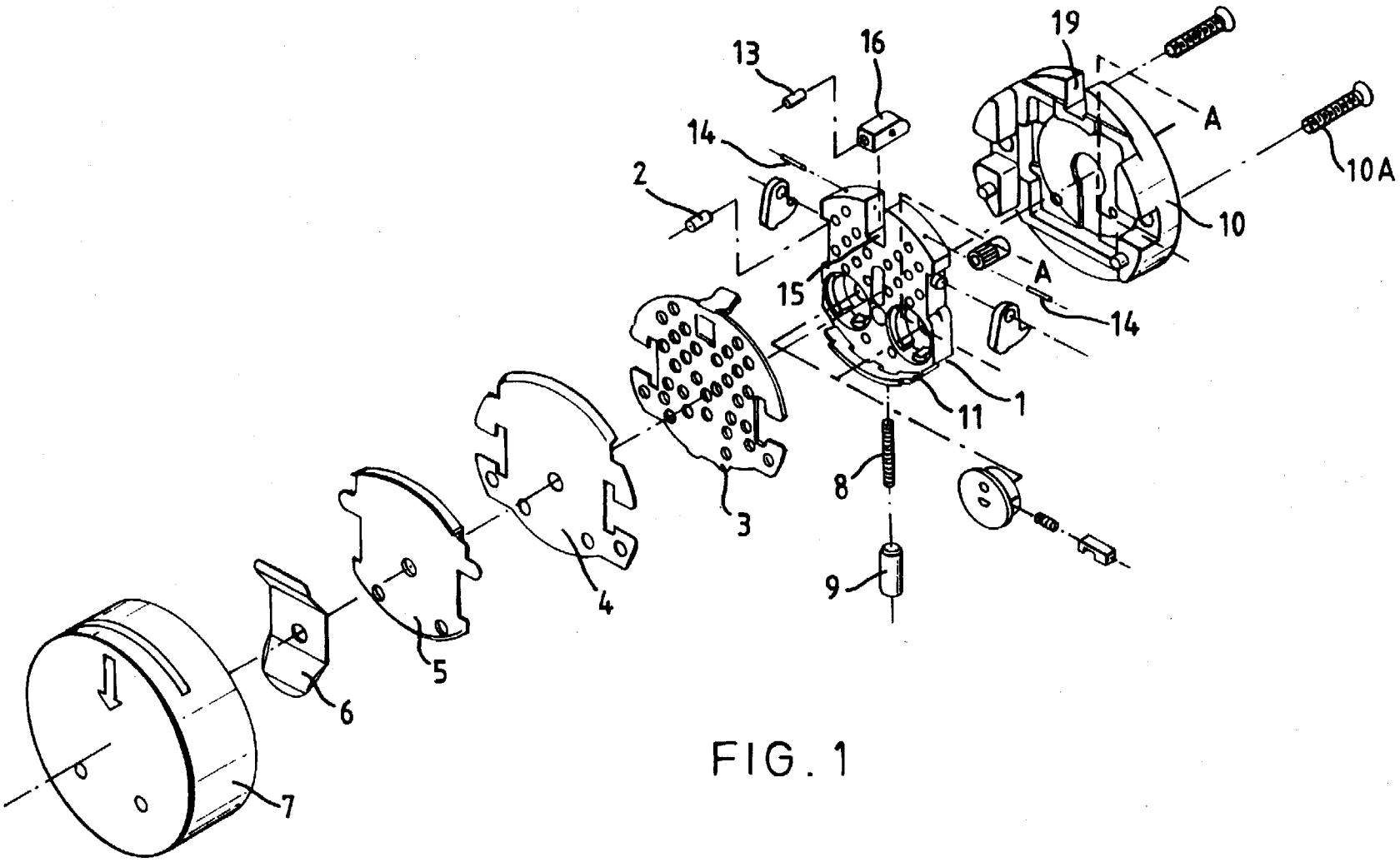
FIG. 1 is an exploded isometric view of a lock.

Referring to the drawings, in FIG. 1 a non-magnetic slide member 1 carries a number of magnet pins 2 which fit snugly in the member 1 and are slidable transversely. A fixed locking plate 3 has a number of respective apertures or holes into which the pins 2 are magnetically biassed towards a non-magnetic cover plate 4 by a magnetic shield plate 5. The cover and shield plates form sides of a slot for insertion of a magnetically coded key (not shown) in known manner. The shield plate 5 is pressed against the cover plate 4 by a flat spring 6 whenever there is no key in the slot. A non-magnetic housing 7 is provided to contain the components described so far and the member 1 is spring biassed by a spring 8 in an upward position, in relation to the Figure. The spring 8 and a central pin guide 9 are partially contained in a hole (not shown) in the bottom of the slide member 1. A rear housing 10 supports one side of the slide member 1 and is secured to the housing 7 by a number of screws 10A, only one screw is shown. When there is no key in the slot, the magnet pins 2 being attracted by the plate 5 and aligned with respective apertures in the lock plate 3, are partially entered in the apertures to prevent downward movement of the slide member 1 in the housings 7 and 10.

When a correctly coded key is inserted in the slot, between the plates 4 and 5, and touches a bottom lip 11, extending across the bottom of the slide member 1, all the pins are repelled by the magnetic code on the key. The magnet pins therefore move into the slide member 1 and out of the locking plate 3 to free the slide member 1 to move downwards as the key is pushed further into the slot. Thus, the slide member 1 can move from its locked position to its unlocking position. A projection on the rear of the slide member 1 engages and moves a latch or bolt mechanism (not shown) to provide an unlocking operation of the lock.

It will be appreciated that in the arrangement described so far it may be possible by applying sharp repeated blows on the outer end surface of the housing 7, so-called "rapping", such that the magnet pins 2 are caused to move into the slide member 1 and out of the locking plate 3. If a blank card or a wrongly coded key is simultaneously inserted into the slot and against the lip 11, by applying continuous or intermittent pressure to the slide member 1 using the card or key, the slide member 1 may be moved by the card in a situation when all the magnet pins 2 are briefly and temporarily displaced by a sharp impact out of the locking plate.

To prevent successful rapping the described lock is provided with an "anti-rap" magnet pin 13 pivotably mounted about an axis, transverse to the normal direction of sliding movement of the slide member 1, on pivot pins 14. The pins 14 are interference fits in holes in the slide member 1. The anti-rap pin 13 is mounted in a cut-out notch 15 formed in the slide member 1.

Figure 2A:
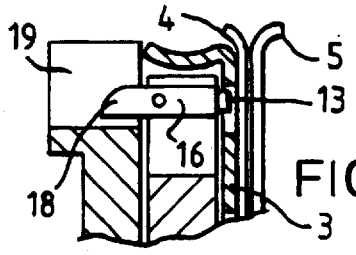
FIG. 2*a* shows a first side view of the lock with the magnetic pin in the aperture.

In FIG. 2*a*, the magnet pin 13 which is securely housed in a non-magnetic bar 16 is shown in a first position with one end of the pin entered into an aperture 17 in the locking plate 3. The bar 16 extends beyond the pins 14, that is, beyond the pivot axis of the magnet pin 13, where the extension 18 of the bar 16 is housed in a cut-out 19 in the housing 10. In normal use, the bar 16 with the pin 13 inserted inside is arranged to balance horizontally about the pivot axis. The bar 16 is normally held in the position shown in FIG. 2*a* by the magnetic attraction of the magnetic shield plate 5. Rapping as described above cannot move the magnet pin 13 because its movement in a direction transverse to the normal movement of the slide member 1 is prevented by its being pivoted about an axis transverse to any movement that could be caused by the particular sharp blows mentioned. Further, should all the other magnet pins in the locking plate 3 be simultaneously disturbed by rapping, the slide member 1 cannot be moved downwards because the extension 18 of the bar 16 holds the end of the slide member 1 at one side and the pin 13 in the locking plate 3 holds the other side of the slide member 1 in its locked position.

Figure 2B:
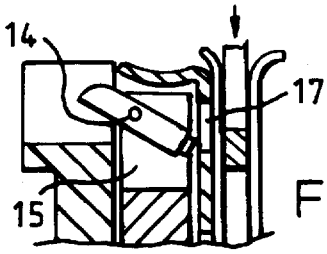
FIG. 2*b* shows a second side view of the lock with the magnetic pin partially rotated out of the aperture.

It will be noted that the magnet pin 13 will not be dislodged from the aperture 17 by any magnetic material pushed into the slot, as it would attract the magnet pin 13, as would a coded key with an attracting spot. In order to dislodge the magnet pin 13, the pin must be acted upon by a repelling magnet which is moved past the aperture 17 in a manner to cause the bar 16 to pivot and so move the remote end of the magnet pin 13 downwards, as seen in FIG. 2*a*. Thus, a correctly coded key must be provided with an oppositely polarised magnet or repelling spot so as to cause the pin 13 to pivot out of the aperture 17 as the key is moved into the slot to operate the lock and before the key presses against the lip 11. The action is shown in FIG. 2*b*.

Figure 2C:
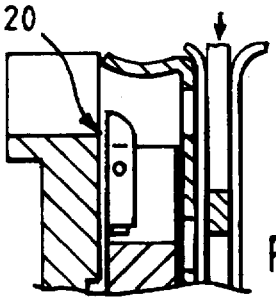
FIG. 2*c* shows a third side view of the lock with the bar fully rotated.
Figure 2D:
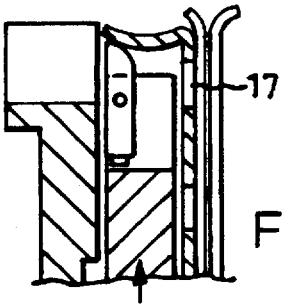
FIG. 2*d* shows a fourth side view of the lock with the extension engaging the round end of the locking plate.

When a correctly coded key is pressed against the lip 11 (FIG. 1) the remote end of the magnet pin 13 will have already been moved out of the aperture 17, the slide member 1 will then be free to move downwards. The extension 18 of the bar engages a shoulder 20 at the base of the cut-out 19, to further pivot the bar 16 to the position shown in FIG. 2*c*.

Figure 2E:
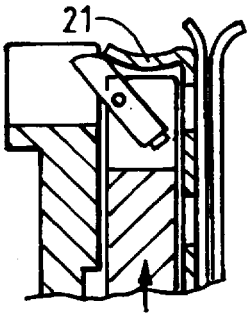
FIG. 2*e* shows the rounded end of the locking plate urging the bar to pivot.

As the key is removed, the slide member 1 moves upwards towards its locked position and the extension 18 engages a rounded end 21, a protrusion on or formed from the locking plate 3. The end 21 urges the bar 16 to pivot in an opposite direction from before so that the extension moves towards and into the cut-out 19 and the remote end of the magnet pin 13 re-enters the aperture 17 (as shown in FIG. 2*e*). Thus, the slide member 1 returns to its fully locked position shown in FIG. 2*a*.

Figure 3A:
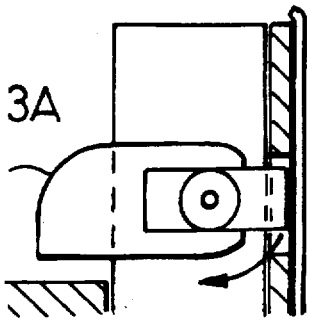
FIG. 3A illustrates a schematic side view of the lock without a card or key.
Figure 3B:
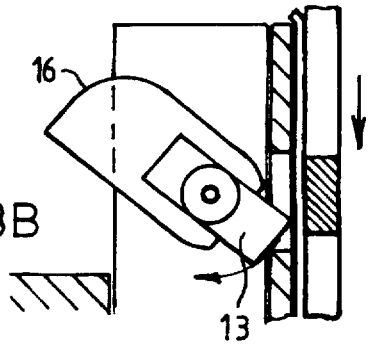
FIG. 3B shows a schematic side view of the lock with a card inserted and the magnetic pin partially deflected.
Figure 3C:
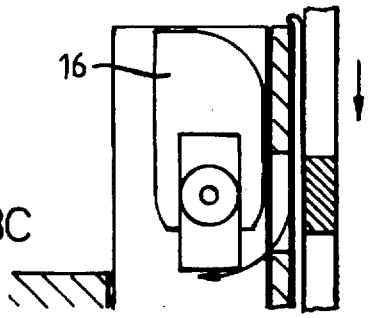
FIG. 3C shows a schematic side view of the lock with the bar fully deflected.
Figure 3D:
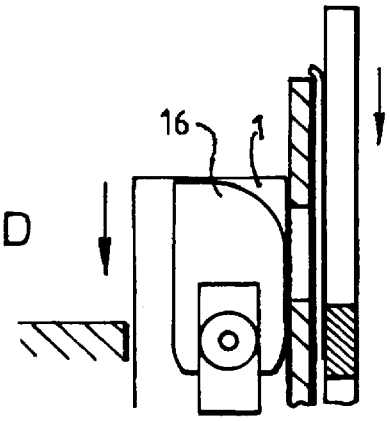
FIG. 3D shows a schematic side view of the lock with the slide member pushed downwards by the card.
Figure 4:
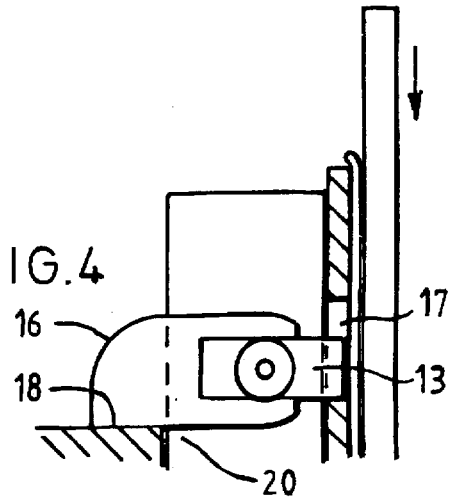
FIG. 4 illustrates a schematic side view of the lock with an incorrect card inserted.

In FIGS. 3A to 3D and in FIG. 4, the sequence of operation is shown again in simplified drawings.

In FIG. 3A the magnet pin 13 in the bar 16 is attracted to the steel shield plate (not shown); no card or key is in the slot. FIG. 3B shows the first action as a correctly coded card is inserted and the magnetic spot on the coded card deflects the remote end of the magnet pin 13 downwards. In FIG. 3C the bar 16 has been deflected as far as it can rotate and in FIG. 3D the bar 16 is shown in position where the slide member 1 is pushed downwards by the card. FIG. 4 shows an incorrect key inserted and where rapping is attempted, the bar 16 does not deflect from its original position as the impacts are directly in line with the magnet pin 13. The remote end of the pin 13 therefore remains in the aperture 17 and the extension 18 bears against the shoulder 20 to prevent the slide member 1 moving from its locked position.

The above described anti-rap arrangement is effective in all slot positions of the lock; top, bottom or to either side, the bar 16 being balanced. Although shown with a single bar 16, a plurality of bars and magnet pins can be contained in a single slide member in different locations.

A complete lock mechanism can be made utilizing a plurality of swinging bars containing magnet pins of various polarities in place of or in addition to normal sliding magnet pins such as magnet pins 2. Such configurations would be especially advantageous for a padlock or other lock that is movable or is fixed to a movable device such as a cabinet, storage box or chest, small portable safe, appliance, computer, etc. Care must be taken in locating the magnet pins in such locks so that the remote ends of the magnet pins in the swinging bars are not urged out of their apertures in the locking plate by adjacent magnet pins. The lock coding can be made more secure if the adjacent pins cause the swinging bars to remain horizontal and perpendicular to the sliding surfaces of the slider. Fixed position magnet pins, such as magnet pin 2, could be utilized for this purpose in addition to their locking function.

Another anti-rap arrangement will be described with reference to FIGS. 5 to 10.

Figure 5:
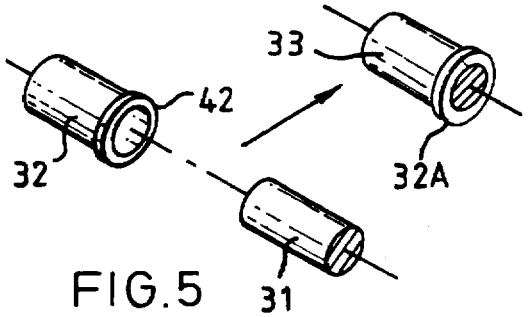
FIG. 5 illustrates an isometric view of the magnetic pin and sleeve.

In FIG. 5 a 'standard' magnet pin 31, that is, having a uniform cross sectional along its total length, is press-fitted into a sleeve or eyelet 32 formed of plastics, magnetic or non-magnetic material. The sleeve has a peripheral flange 32A at one end. The pin 31 and sleeve 32 comprise a magnet assembly 33.

Figure 6:
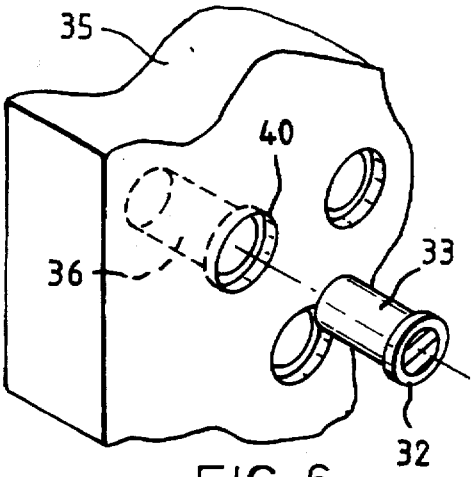
FIG. 6 illustrates an exploded perspective view of the assembly of FIG. 5 as it fits into a portion of the slide member.

In FIG. 6, a part 35 of the slide member 1 (of FIG. 1) is shown with apertures 36 to receive the assembly 33. The assembly 33 fits snugly in a respective aperture and is constrained to slide along a fixed axis with respect to the part 35. The front ends of the apertures 36 are countersunk at 40 to receive peripheral flanges 32A of the assemblies 33 so that the front ends of the assemblies can fit flush with the front surface of the part 35 when the assemblies are fully seated in a respective apertures 36. The flange 32A prevents the assembly 33 passing through the aperture 36 so ends of the apertures 36 may extend completely through the part 35.

Figure 7:
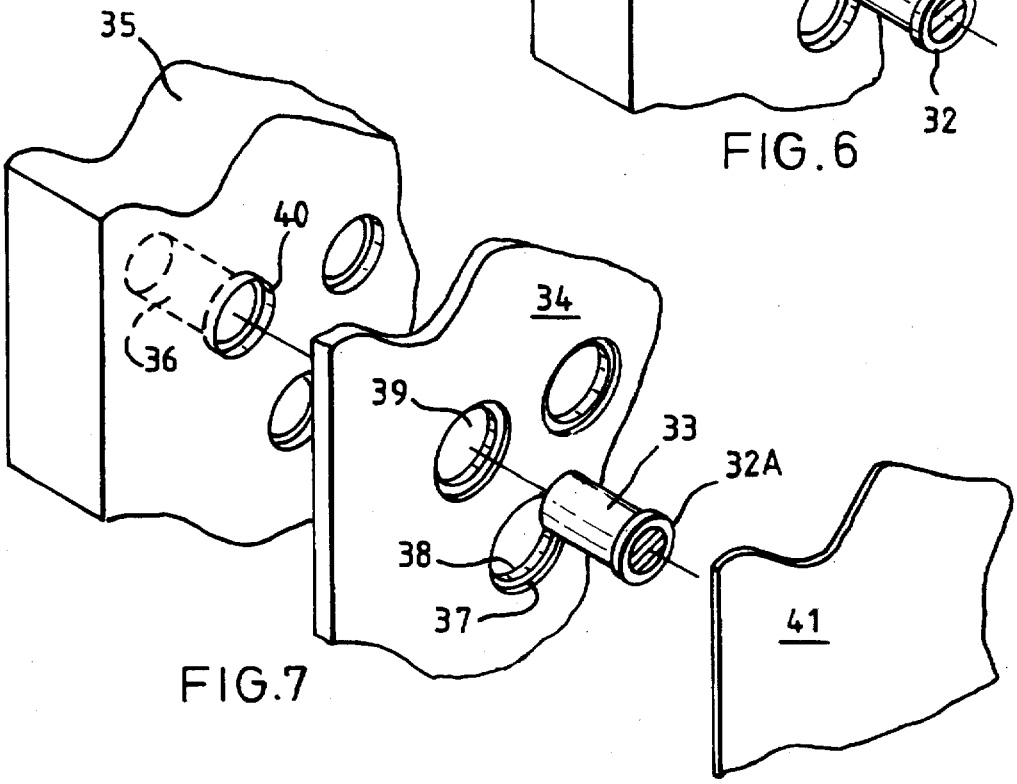
FIG. 7 shows an exploded perspective view of a portion of the lock plate in a "normal" position.

In FIG. 7, a part 34 of the lock plate 3 (FIG. 1) is shown in a normal position, although separated for clarity, relative to the part 35 of the slide member. Stepped holes 37, 38, 39 are provided in the lock plate in which smaller inner diameters at 38 of the holes 39 are somewhat larger than the diameter of the flanges 32A. The step in each hole 39 has a width approximately equal to the width of the rims of the flanges 32A. A part 41 of the cover plate 4 (of FIG. 1) is also shown.

Figure 8:
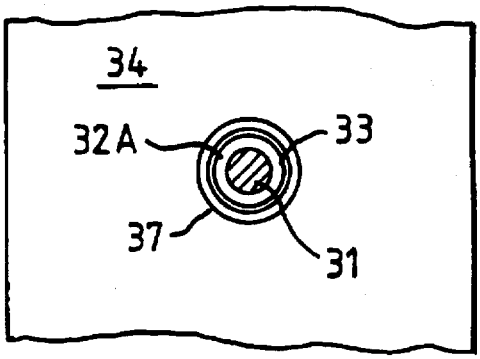
FIG. 8 shows a front view of parts of the other lock.
Figure 9:
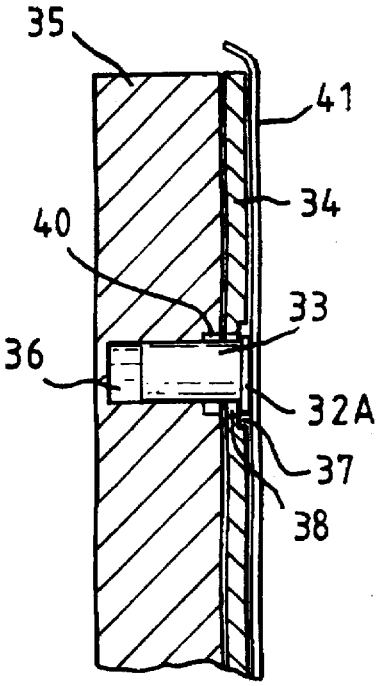
FIG. 9 is cross sectional view of FIG. 8.

In FIG. 8, the arrangement of FIG. 7 is shown with the part 41 removed and with the assembly 33 positioned concentrically with the central axis of a respective stepped hole 39. FIG. 9 shows the side view of FIG. 8 with the part 41 in position. Normally, that is when a correctly coded key is not in the slot of the lock and the slide member is in its fully locked position, the pin assembly 33 will remain as shown with its forward end against the plate 41. If a correctly coded key is inserted in the slot, as described with reference to FIG. 1, the pin assembly 33 will be urged into the body 35 and its remote end will move out of the locking plate 34 to allow the slide member to move downwards relative to the locking plate 34 to its unlocking position as required.

Figure 10:
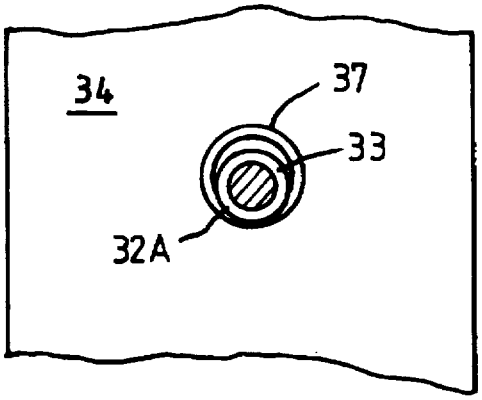
FIG. 10 shows a front view of the parts of the other lock in relative different positions to the view in FIG. 8.
Figure 11:
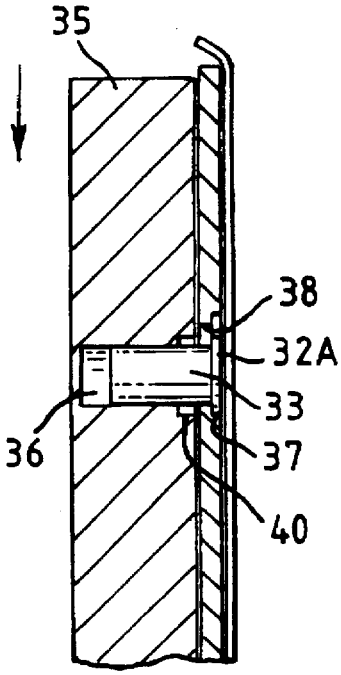
FIG. 11 shows a cross-sectional view of FIG. 10.
Figure 12:
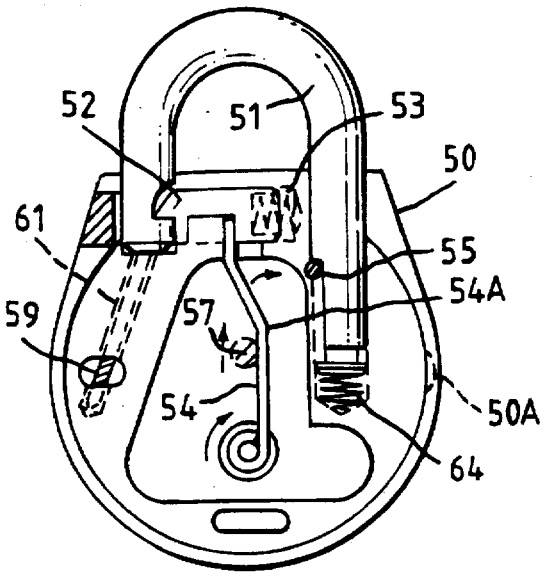
FIG. 12 shows a front view of a padlock mechanism in a lock closed configuration.
Figure 13:
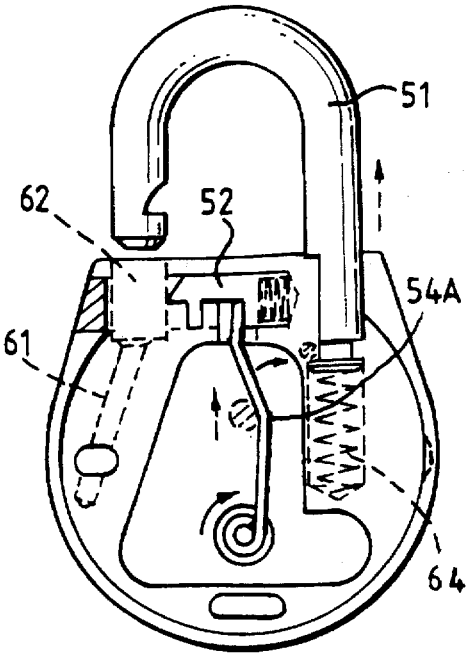
FIG. 13 shows a front view of the padlock mechanism in a lock open configuration.
Figure 14:
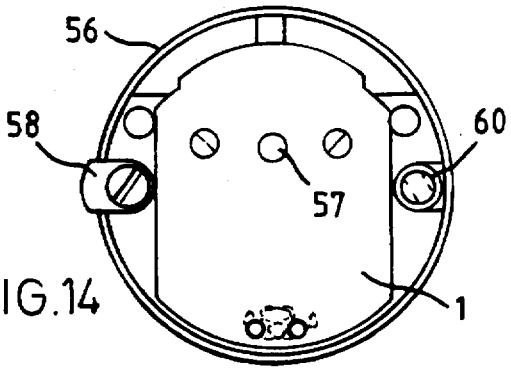
FIG. 14 shows a rear view of a magnetic code module for use with the padlock mechanism.
Figure 15:
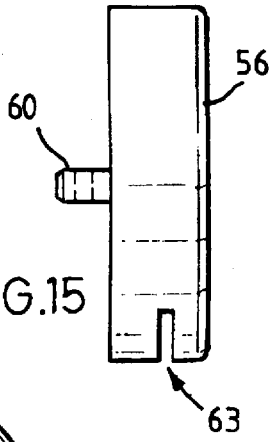
FIG. 15 shows a side view of FIG. 14.
Figure 16:
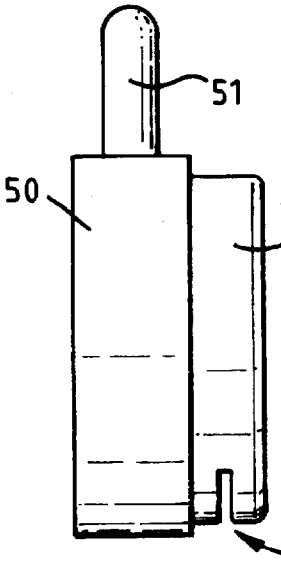
FIG. 16 shows a side elevation view of a padlock mechanism in the locked configuration.
Figure 17:
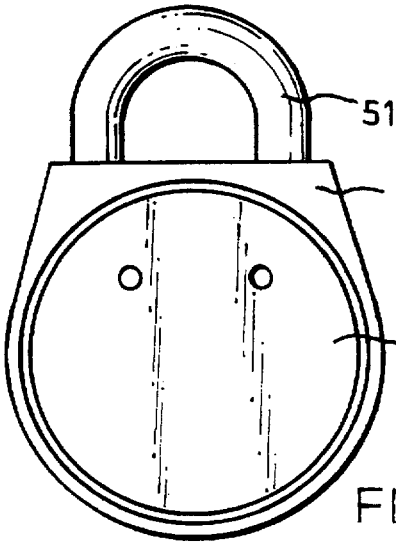
FIG. 17 shows a front elevation view of a padlock mechanism in the locked configuration.

In FIGS. 10 and 11, the assembly 33 while remaining snugly in respective aperture 36, so as to be still restrained to slide only along a fixed axis within the aperture 36, is no longer centrally aligned with the central axis of a respective stepped hole 39. The flange 32A is pressed against the side of the step and so the remote end of the assembly 33 cannot move out of the locking plate 34. In the configurations shown in FIGS. 10 and 11, which will normally have resulted in use because of rapping or other tampering and where the slide member 35 has been moved to some extent from its fully locked position, the lock cannot be operated. In other words, if the slide member 35 is no longer accurately aligned with the locking plate 34, the pin assembly 33 is mechanically prevented from moving laterally as required to allow the slide member to move relative to the locking plate. If a properly coded key is inserted, which acts to repel the assembly 33 into the slide member 35 before the slide member moves at all, relative to the locking plate, then the slide member 35 can move from its locked position to its unlocking position as required.

It will be appreciated that the anti-rap arrangement shown in FIGS. 5 to 11 may normally be provided using only one magnet assembly 33 for each lock. It is however possible to use the assembly 33 for two or more or all the magnet pins in a lock. In this respect the apertures 36 in the body 35 as shown in the drawings can be used for the assemblies 33 as well as for otherwise standard pins that is, uniform cross-section pins having outside diameters which fit snugly in the apertures 36. It will also be appreciated that the assembly 33 may be formed integrally of magnet material and not as two different parts as described.

The locking plate 34 may be formed with the stepped holes 39 of much greater diameter than shown in the drawings. All that is required normally is for the diameter to be at least large enough to accept the full rim of the flanges 32A when the slide member 1 is displaced with respect to the part 35. In this respect, the plate 34 may be formed of a sandwich of two separate plates, the one plate having holes with diameters shown at 38 and the other plate having holes at least as large as shown at 37. The other plate may however be in the form of an open mesh or latticework but of sufficient thickness to provide a clearance for the rims 32A in a direction parallel to the longitudinal axes of the assemblies 33.

The two anti-rap arrangements, one described with reference to FIGS. 2 to 4 and the other described with reference to FIGS. 5 to 11 may be used together in one lock. Such locks will be even less prone to rapping than any lock which has only one of these two anti-rap arrangements.

A particular application for special consideration against rapping is a padlock where the lock is exposed and prone to sharp impacts which can be applied externally in all directions. Also, padlocks are often used in open and often remote locations or perhaps on articles than can be taken away to private locations where rapping is less likely to attract attention, or disturb or alert other people or cause any suspicion.

A padlock incorporating both the arrangements of FIGS. 2 to 4 and of FIGS. 5 to 11 will now be described with reference to FIGS. 12 to 17. The use of both greatly improves resistance against rapping in any direction to the padlock.

The padlock consists of a body 50, a shackle 51, a shackle latch 52, a latch compression spring 53, a pivoted release arm 54, a shackle retainer pin 55, a magnetic key operated anti-rap module 56 with an actuator 57 on its slide member.

The module 56 incorporates both anti-rap arrangements described above but are not shown. The module 56 is held against one side of the body 50 by a side tab 58 which extends behind a rim at 50A of a depression into the body and the module 56 is retained in position by a grub screw 59. The grub screw 59 passes through a hole in a post 60 and is threaded in a channel 61 and reached through a shackle hole 62.

For normal operation of the padlock, a correctly coded card is inserted into slot 63 in the module 56 from the bottom of the padlock opposite the shackle 51. The card releases the slide member 1, as described for example with reference to FIG. 1, to slide upwards so that the actuator 57 rides up the release trigger arm 54 and past its elbow 54A. The top end of the arm 54 is thus moved to the right (in relation to FIG. 12) to retract the shackle latch 52. A compression spring 62 can then lift the shackle 51 to clear the body 50 as required.

To recode, service or remove the anti-rap module 56 for some other purpose, an allen wrench is used to unscrew the grub screw 59 through the shackle hole 62 when the one end of the shackle is removed to allow the module 56 to be removed from the body 50. The module is swung away, pivoting about the tab 58, so that the post 60 is removed from the body 50 and then the module is slid sideways to free the tab 58 from the depression in the body at 50A. To fit the module, the procedure is reversed and the grub screw entered in the hole in the post 60 to retain the module in position against one side of the body 50.

The anti-rap module may incorporate magnetic code changing arrangements and code changers which include rotatable carriers for retaining one or more of the magnet pins forming the code. Magnetic code changing arrangements are fully described, for example, in PCT Application PCT/GB90/00246 (Publication No. WO 90/09503) using a code changing card in the lock or a key inserted from outside the lock. The two forms for changing the lock can be used together or separately; they are shown combined in FIG. 15 of the PCT Application. In both these cases, the code is changed by relatively rotating one or more magnet pin carriers in the lock module.

I claim:

1. A magnetic key operated lock comprising:

a slide member movable in a direction from a locked position to an unlocking position with a key having an encoded magnetic code inserted in said lock;

a plurality of magnet pins arranged to be slidable in a direction transverse to the direction of movement of said slide member from a first portion locking said slide member in said locked position, in which remote ends of said magnet pins extend beyond a surface of said slide member, to a second position unlocking said slide member on operation of said lock by said key;

a locking plate mounted adjacent said slide member having a plurality of apertures for receiving said remote ends of said magnet pins when said slide member is in said locked position, the position and polarity of said magnet pins forming a code for said lock; and means for supporting at least one of said magnet pins in said slide member such that said remote end of said at least one of said magnet pins is prevented mechanically from moving transversely out of a respective aperture in said locking member when said lock is rapped.

2. A lock according to claim 1, in which said at least one of said magnet pins is pivotally mounted in said slide member so as to be rotatable about an axis transverse to slidable directions of other said magnet pins so that said remote end of said at least one of said magnet pins is enabled to move out of said respective aperture in said locking plate by pivoting in a direction of movement of said coded key into said lock.

3. A lock according to claim 2, in which said at least one of said magnet pins extends forming an extension beyond said axis transverse to said slidable directions of said other said magnet pins and said lock includes a shoulder which is urgable against said extension to pivot said at least one of said magnet pins in a direction to move said at least one of said magnet pins into alignment with said slide member as said slide member moves towards said unlocking position.

4. A lock according to claim 3, including a protrusion mounted adjacent one end of said slide member engaging said extension when said slide member moves from said unlocking position towards said locked position to cause said at least one of said magnet pins to pivot in an opposite direction and said remote end of said at least one of said magnet pins to move into said respective aperture in said locking plate.

5. A lock according to claim 1, in which said at least one of said magnet pins is formed to fit snugly in said slide member, so as to be movable in said slide member only along a fixed axis, said at least one of said magnet pins being provided with a lateral protrusion at said remote end of said at least one of said magnet pins fit flush with a surface of said slide member in an indentation in said surface, and said lock plate having a stepped aperture through which said lateral protrusions are passable and lodgable against a step of said stepped aperture to prevent travel of said remote end of said at least one of said magnet pins away from said locking plate unless said fixed axis of said magnet pin is aligned with a central axis of said stepped aperture.

6. A lock according to claim 5, in which said lateral protrusion further comprises a peripheral rim at said remote end.

7. A lock according to claim 5, wherein said at least one of said magnet pins further comprises a uniform cross-section along a total length thereof and said at least one of said magnet pins retained in a separate sheath fit in said slide member, said sheath being integrally formed with said lateral protrusion.

8. A lock according to claim 7, wherein said sheath is formed of a plastic material.

9. A lock according to claim 1, further comprising a first magnet pin pivotally mounted in said slide member so as to be rotatable about an axis transverse to slidable directions of said other magnet pins whereby a remote end of said first magnet pin is enabled to move out of said respective aperture in said locking plate by pivoting in a direction of movement of said coded key into said lock, and a second magnet pin which is formed to fit in said slide member, so as to be movable in said slide member only along a fixed axis, said second magnet pin having a lateral protrusion at said remote end of said second magnet pin fit flush with a surface of said slide member in an indentation in said surface, and said lock plate having a stepped aperture through which said lateral protrusion is passable and lodgable against a step of said stepped aperture to prevent travel of said remote end of said second magnet pin away from said lock plate unless said fixed axis of said second magnet pin is aligned with a central axis of said stepped aperture.

10. A padlock having a magnetic key operated lock comprising: an anti-rap module having a slide member released to move when a correctly coded card is inserted in said module, said padlock further comprising a release arm mechanically cooperating with said slide member when said slide member moves to allow said padlock to open, said module removably secured to said padlock.

11. A padlock according to claim 10, wherein said module is mounted on one side of said padlock.

12. A padlock according to claim 10, wherein said module is arranged with a slot for receiving a magnetic card positionable at a bottom of said lock opposite a shackle of said padlock.

13. A padlock according to claim 10 wherein said module is releasable by removing a fixing means inside said lock, said fixing means accessible through a shackle hole in said padlock.

14. A magnetic key operated lock comprising:

a slide member movable in a direction from a locked position to an unlocking position with a key having an encoded magnetic code inserted in said lock;

a plurality of magnet pins arranged to be slidable in a direction transverse to the direction of movement of said slide member from a first position locking said slide member in said locked position, in which remote ends of said magnet pins extend beyond a surface of said slide member, to a second position unlocking said slide member on operation of said lock by said key;

a locking plate mounted adjacent said slide member having a plurality of apertures for receiving said remote ends of said magnet pins when said slide member is in said locked position, the position and polarity of said magnet pins forming a code for said lock; and means for supporting at least one of said magnet pins in said slide member such that said remote end of said at least one of said magnet pins is prevented mechanically from moving transversely out of a respective aperture in said locking member when said lock is rapped, said at least one of said magnet pins snugly fitting in said slide member, so as to be movable in said slide member only along a fixed axis, said at least one of said magnet pins being provided with a lateral protrusion at said remote end of said at least one of said magnet pins fit flush with a surface of said slide member in an indentation in said surface, and said lock plate having a stepped aperture through which said lateral protrusions are passable and lodgeable against a step of said stepped aperture to prevent travel of said remote end of said at least one of said magnet pins away from said locking plate unless said fixed axis of said magnet pin is aligned with a central axis of said stepped aperture, said at least one of said magnet pins further comprises a uniform cross section along a total length thereof and said at least one of said magnet pins retained in a separate sheath fits in said slide member, said sheath being integrally formed with said lateral protrusion.

15. A lock according to claim 14, wherein said sheath is formed of a plastic material.

* * * * *